US006732727B1

(12) United States Patent
Gallops, Jr.

(10) Patent No.: US 6,732,727 B1
(45) Date of Patent: May 11, 2004

(54) ARCHERY BOW WITH BOW SPEED SPECIFIC SIGHT PIN BLOCK

(75) Inventor: Henry M. Gallops, Jr., Gainesville, FL (US)

(73) Assignee: Bear Archery, LLC, Gainesville, FL (US)

( * ) Notice: Subject to any disclaimer, the term of this patent is extended or adjusted under 35 U.S.C. 154(b) by 0 days.

(21) Appl. No.: 09/648,887

(22) Filed: Aug. 25, 2000

(51) Int. Cl.[7] ..... F41G 1/467
(52) U.S. Cl. ..... 124/87; 33/265
(58) Field of Search ..... 124/87, 23.1, 86, 124/88; 33/265

(56) References Cited

U.S. PATENT DOCUMENTS

| | | | | | |
|---|---|---|---|---|---|
| 2,332,080 | A | | 10/1943 | Howe | 124/24.1 |
| 2,574,599 | A | * | 11/1951 | Steiber | |
| 2,998,652 | A | | 9/1961 | Zielnski | 33/265 |
| 3,310,875 | A | | 3/1967 | Kowalski | 33/265 |
| 3,579,839 | A | | 5/1971 | Kowalski | 33/265 |
| 3,822,479 | A | | 7/1974 | Kowalski | 33/265 |
| 4,328,625 | A | * | 5/1982 | Carella | 33/265 |
| 4,543,728 | A | | 10/1985 | Kowalski | 33/265 |
| 5,406,712 | A | * | 4/1995 | Slates | 33/265 |
| 5,442,861 | A | | 8/1995 | Lorocco | 33/241 |
| 5,560,113 | A | | 10/1996 | Simo et al. | 33/265 |
| 5,649,526 | A | | 7/1997 | Ellig | 124/87 |
| 5,682,871 | A | | 11/1997 | Walk | 124/88 |
| 5,685,081 | A | | 11/1997 | Winegar | 33/265 |
| 5,836,294 | A | | 11/1998 | Merritt | 124/87 |

OTHER PUBLICATIONS

Advertisement for "Bear Premier Hunting Sight".

* cited by examiner

*Primary Examiner*—John A. Ricci
(74) *Attorney, Agent, or Firm*—Woodard, Emhardt, Moriarty, McNett & Henry LLP

(57) ABSTRACT

An archery bow including a bow speed specific sight pin block having sight pin openings for sight pins located therein relative to each other at fixed distances for a given bow speed, so that when a single sight pin is manually positioned to indicate its corresponding arrow flight range, each of the other sight pins in the other openings will be in position to indicate their corresponding arrow flight range. The sight pin block may be mounted in a riser opening and allen screws may be included in the bowsight pin block frame for moving wedges located in the bowsight pin block frame into engagement with a sidewall of the riser opening for mounting the bowsight pin block in the riser opening.

10 Claims, 5 Drawing Sheets

ARCHERY BOW WITH BOW SPEED SPECIFIC SIGHT PIN BLOCK

BACKGROUND OF THE INVENTION

1. Field of the Invention

This invention relates to the field of archery bowsights which are mounted on archery bows to assist the shooter in determining the range of a shot and more specifically to a bowspeed specific sight pin block in which the sight pins may be readily positioned to indicate their corresponding arrow flight range.

2. State of the Art

For aiming a bow, an experienced archer will typically nock an arrow in the same position on the bowstring and draw the bowstring until a particular portion of the archer's hand touches a particular portion of the archer's head. With the drawn arrow in this position, the remaining variable in control of the archer during the shot is the desired arrow flight range. For increased range, the bow is raised, and for decreased range the bow is lowered.

Vertically spaced pin sights, well known in the prior art, assist the archer in determining the extent to which the bow should be raised or lowered to achieve the desired range. The vertical location of each pin sight is set by the archer to aim for the desired range. For example, in a bow shooting 280 feet per second, the pin sights may be set by the archer to shoot 20, 30, 40, 50 and 60 yards, with the highest pin calibrated to shoot the shortest yardage, 20 yards, and the lowest pin calibrated to shoot the longest yardage, 60 yards. The archer will select the pin sight which is calibrated for the desired range and raise or lower the bow until the selected pin sight is at eye level.

Setting the vertical location of each individual pin sight for its corresponding arrow flight range is a time consuming effort. It may, for example, take an archer three dozen or so shots to determine the proper vertical location for each pin sight. Since it is not unusual for five or more pin sights to be utilized, an archer may spend several hours adjusting the pin sights. Should the bow speed be changed because of a heavier arrow being shot, or for other reasons, so that the pin settings no longer accurately indicate the arrow range, the archer will be required to repeat the time consuming pin setting procedure for the new arrow range.

Certain prior art bowsights, such as disclosed in U.S. Pat. No 5,560,113 to Simo et al., include a pin block in which a number of vertically adjustable sight pins were located. Simo et al. is an example of a bow sight in which the archer was required to laboriously determine the vertical position of each individual pin sight for its corresponding arrow flight range. The Simo et al. patent is also an example of a bow sight which requires an independent bracket member mounted on the bow riser. At least one prior art bowsight, sold by the Fred Bear Company under the designation "Bear Field Model Premier", included an opening in the bow riser in which a bowsight was mounted. In contrast, to the vertically moveable sight pins disclosed in Simo et al., a patent to Howe, U.S. Pat. No. 2,332,080 disclosed a pin block having fixed openings therein for mounting the pin sights.

SUMMARY OF THE INVENTION

According to the present invention, the locations of openings for mounting pin sights corresponding to different arrow flight ranges for a given bow speed are determined and sight pins are mounted in the openings. In an embodiment of the present invention, the openings are located in a modular self contained sight pin block. Because the locations of the pin sight openings are fixed with respect to each other, when a single sight pin in one of the openings is manually positioned to indicate its corresponding arrow flight range, each of the sight pins in the other openings will be in position to indicate their corresponding arrow flight range.

The bow speed specific sight pin block of the present invention may be simply and securely mounted in the sidewalls of an opening in the riser, although it is emphasized that the bow speed specific pin block of the present invention need not be mounted in an opening in the bow riser. The pin block may, for example, be mounted to the archery bow by a bracket, such as, but not limited to, the type sold by Impact Archery, under the designation "Impact 3-pin Fiber Optic Lite #6521-003", or the type sold by Game Warning Systems under the designation "4-Pin Fiber Optic, Black #6522-044". In the illustrated embodiment, the bowsight pin block frame includes internal allen screws which move wedge elements in the bowsight pin block frame into and out of engagement with sidewalls. To mount the bowsight pin block, the wedge elements are moved into engagement with the sidewalls. To remove the bowsight pin block from the riser, the wedge elements are moved out of engagement with the sidewalls.

It is an object of the present invention to provide an archery bow with bow speed specific pin sight openings so that when a single pin sight in one of said openings is manually positioned to indicate its corresponding arrow flight range, each of the pins in the other openings will be in position to indicate their corresponding arrow flight range.

It is a further object of the present invention to provide an archery bow having a bow speed specific sight pin block, including pin sight openings therein so that when a single sight pin in one of said openings is manually positioned to indicate its corresponding arrow flight range, each of the sight pins in the other openings will be in position to indicate their corresponding arrow flight range.

It is a still further object of the present invention to provide a modular self contained bow speed specific sight pin block which may be conveniently packaged, identified and stored for use or sale according to bow speed.

It is an additional object of the present invention to provide a modular self contained bow speed specific sight pin block wherein the sight pins are readily positioned to indicate their corresponding arrow flight range and wherein the sight pin block may be conveniently packaged, identified and stored for use or sale according to bow speed.

It is also an object of the present invention to provide a bowsight pin block which may be simply and securely mounted in a riser opening without the need for a separate bracket connecting the bowsight to the riser.

Additional objects and advantages of the invention will become apparent to those skilled in the art upon reference to the detailed description taken in conjunction with the combined figures.

DETAILED DESCRIPTION OF THE PREFERRED EMBODIMENTS

Figure 1A:
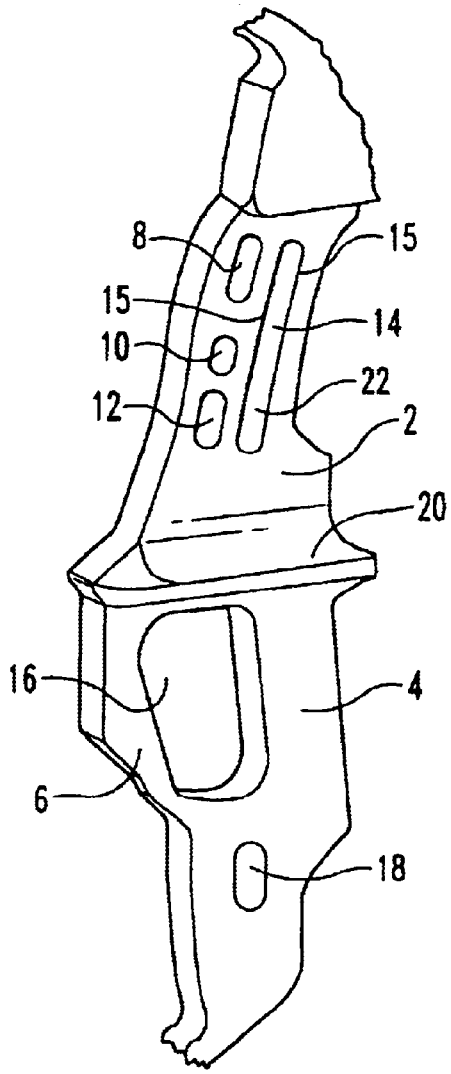
FIG. 1A is a perspective view of an archery bow riser with which the bowsight pin block of the present invention may be used.
Figure 1B:
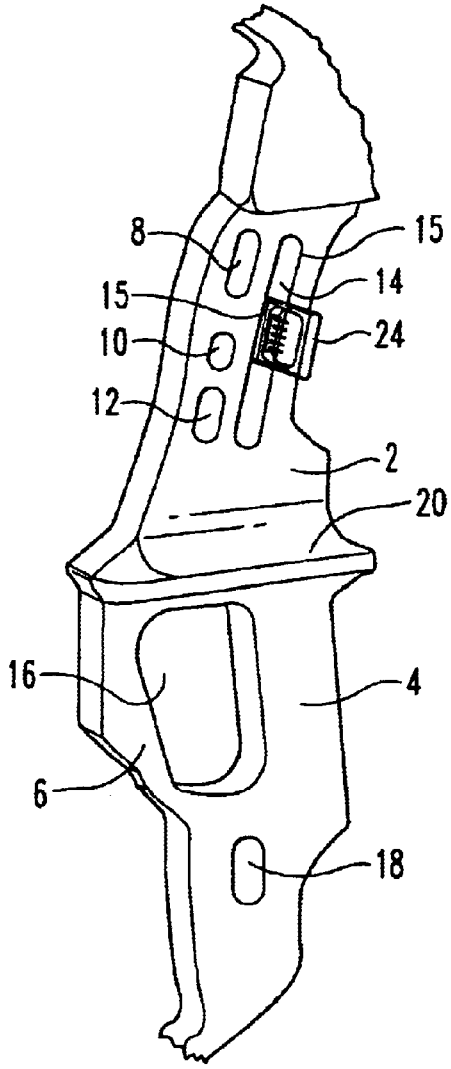
FIG. 1B is a perspective view of the archery bow riser shown in FIG. 1 and wherein the bowsight pin block of the present invention is mounted in the riser.

With reference to FIGS. 1A and 1B, there is shown a riser 2 including a hand grip portion 4, a reinforcement bridge 6, and a number of openings for the purpose of reducing the weight of riser 2. The openings in, the upper portion of riser 2 are identified by reference numerals 8, 10, 12 and 14. The openings in the lower portion of riser 2 are identified by reference numerals 16 and 18. Weight reducing opening 14, having sidewalls 15, includes a recess 22 around its periphery for receiving the bow speed specific sight pin block 24. The shape and number of the openings will vary with particular bows. Riser 2 further includes an arrow receiving portion 20.

Figure 2:
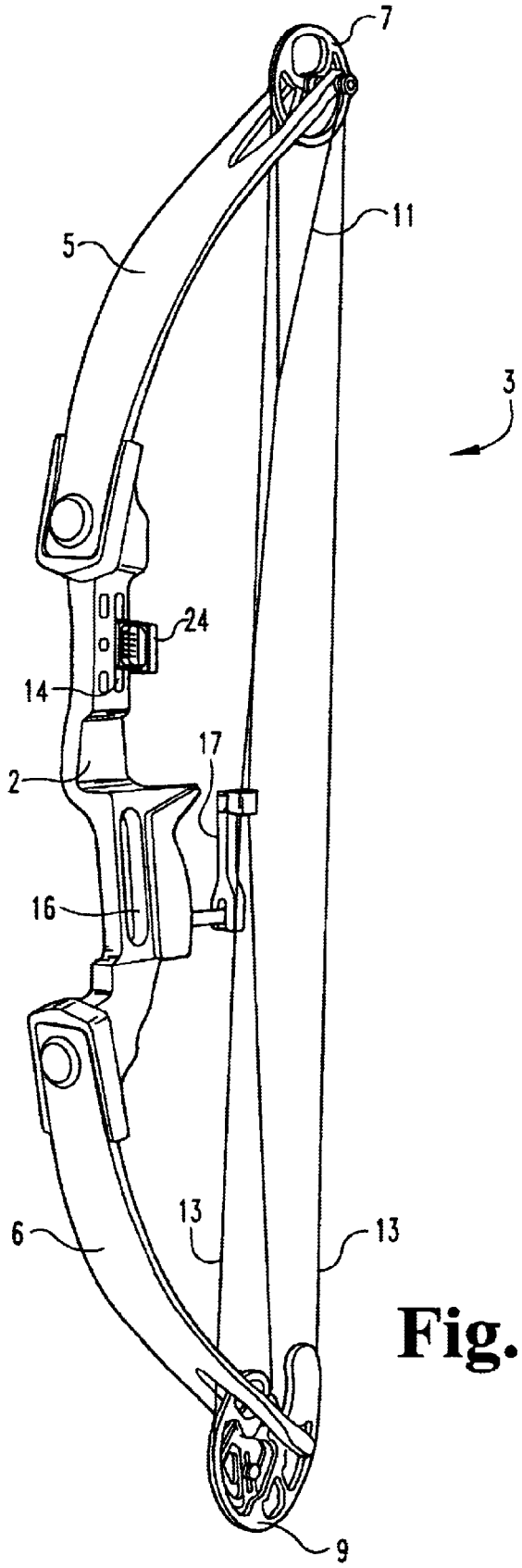
FIG. 2 is a perspective view of the archery bow including the bowsight pin block of the present invention.

With reference to the archery bow 3 shown in FIG. 2, which is of the type sold by Bear Archery L.L.C. under the "T-MASTER" trademark, riser 2 is connected to upper bow limb 5 and lower bow limb 6. A wheel 7 is located within the limb tip of upper bow limb 5 and a cam 9 is located within the limb tip of lower bow limb 6. An anchor cable 11 and feed out cables 13 are provided in known manner. A cable guard 17 is connected to riser 2.

Figure 3:
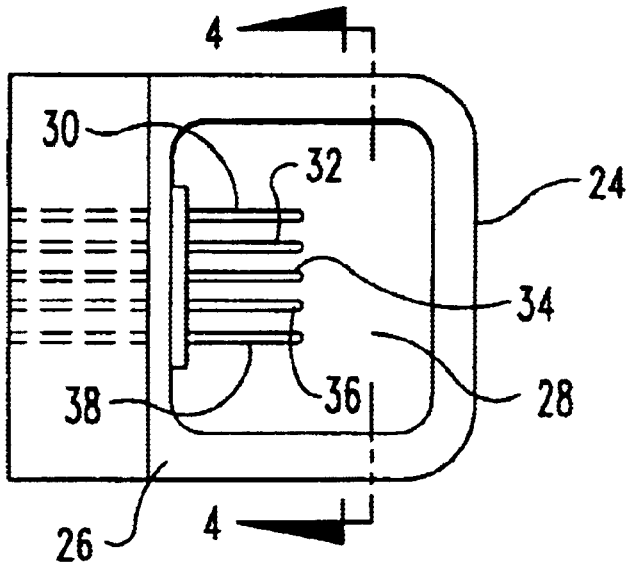
FIG. 3 is a side elevation of the bowsight of the present invention in which the sight pins are mounted in the openings in the bowsight pin block.
Figure 4:
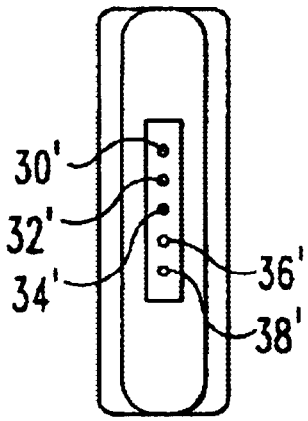
FIG. 4 is a transverse section taken on the line 4—4 of FIG. 3 with the sight pins removed from the openings in the bowsight pin block.
Figure 5:
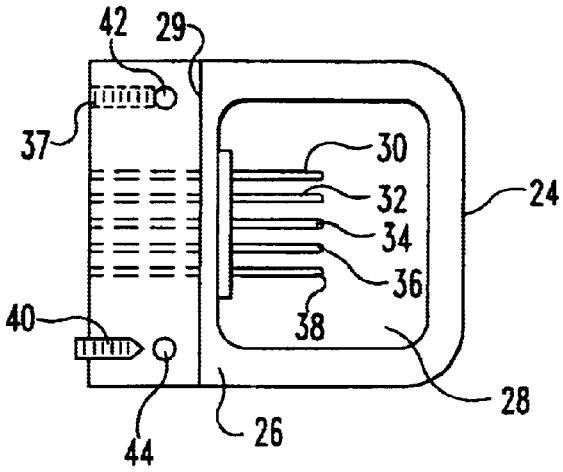
FIG. 5 is a side elevation of the bowsight pin block of the present invention in which an upper wedge is in its extended position and the lower wedge is in its retracted position.
Figure 6:
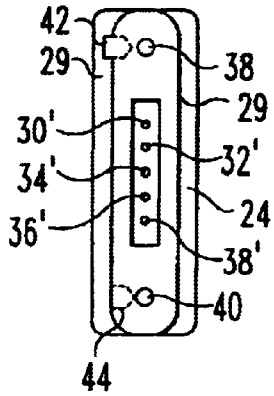
FIG. 6 is a side elevation of the bowsight shown in FIG. 5 wherein the bowsight pin block has been rotated ninety degrees counterclockwise.
Figure 7A:
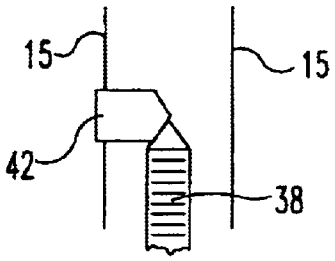
FIG. 7A is a transverse section taken on the line 7A—7A of FIG. 7 and showing an enlarged top plan view.
Figure 7B:
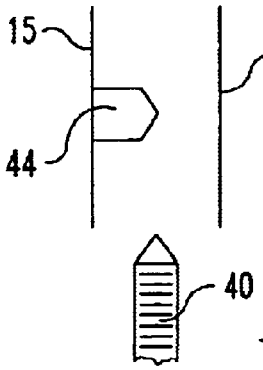
FIG. 7B is a transverse section taken on the line 7B—7B of FIG. 7 and showing an enlarged top plan view.
Figure 7:
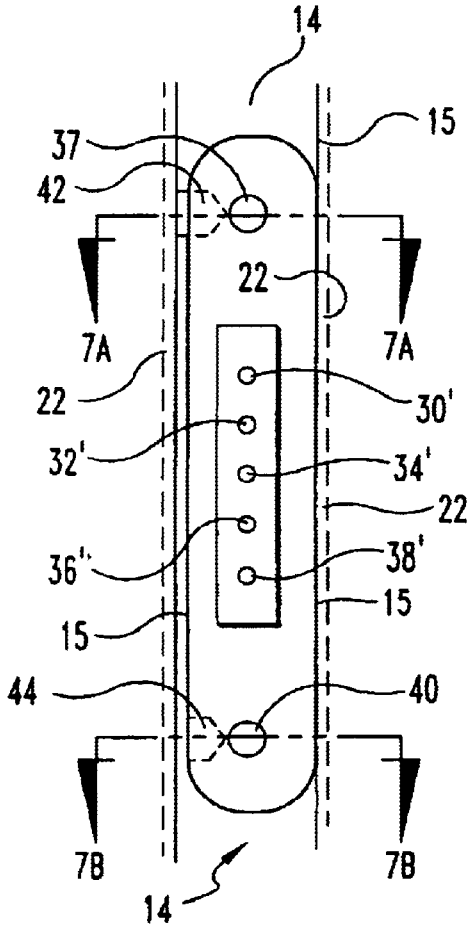
FIG. 7 is an enlarged side elevation of the bowsight shown in FIG. 6 and wherein the upper wedge is in engagement with a sidewall of the riser opening and the lower wedge is out of engagement with the sidewall.

With reference to FIG. 3 it is seen that bowsight pin block 24 comprises a general rectangular frame 26 having a rectangular opening 28 therein. Sight pins 30, 32, 34, 36 and 38 are located in openings 30', 32', 34', 36' and 38' of frame 26. For illustration purposes, the following discussion refers to a bowsight for use in a bow having a speed of 280 feet per second, and, in particular, for determining the relative locations of the openings 30', 32' 34', 36' and 38' so that, when a single sight pin in one of the openings, such as sight pin 30, is manually positioned to indicate its corresponding arrow flight range, each of the other sight pins in the other openings, i.e., openings 32', 34', 36' and 38' will be in position to indicate their corresponding arrow flight range. Thus, it will be understood that only one sight pin need be manually positioned to position all the other sight pins.

In the present example, the opening 30' will correspond to an arrow flight range of twenty yards; the opening 32' will correspond to an arrow flight range of thirty yards; the opening 34' will correspond to an arrow flight range of forty yards; the opening 36' will correspond to an arrow flight range of fifty yards and the opening 38' will correspond to an arrow flight range of sixty yards.

To determine the locations of the openings, it is assumed that the archer has ascertained that the bow speed is 280 feet per second by, for example, shooting the arrow through a chronograph. The archer then shoots the bow seeking a predetermined arrow flight range, for example, 20 yards. The pin sight location at which the 20 yard shot is achieved is determined and a sight pin opening is provided at this location (i.e. in the illustrated example, opening 30' is provided for mounting sight pin 30). Next, the bow is shot to determine the pin sight location at which the 30 yard shot is achieved and at this location, opening sight pin 32' is provided for mounting sight pin 32. As noted in the following table, the fixed distance between opening 30' and opening 32' is 0.089 inches. The procedure is continued until the locations are fixed for a 40 yard arrow flight, opening 34'; a 50 yard arrow flight, opening 36'; and a 60 yard arrow flight opening 38'.

| Opening number | Yardage | Distance from 20 yard pin (inches) | Pin gap (pin to pin) (inches) |
|---|---|---|---|
| 30' | 20 | — | 0 |
| 32' | 30 | .089 | .089 |
| 34' | 40 | .212 | .123 |
| 36' | 50 | .347 | .135 |
| 38' | 60 | .495 | .148 |

The effect of having sight pins in each of these fixed locations relative to the sight pin in opening 30', is that whenever the bow speed specific sight pin block 24 is inserted in an archery bow having a bow speed of 280 feet per second, only a single sight pin in one of the openings need be manually positioned, by raising or lowering pin block 24, to indicate its corresponding arrow flight range. The other sight pins will be in position to indicate their corresponding arrow flight ranges. For example, when the archer raises or lowers pin block 24 within opening 14 of hand grip portion 4, so that sight pin 34 is in position to indicate an arrow flight range of 40 yards, all of the other sight pins will be in position to indicate their corresponding arrow flight ranges.

It is noted that the same pin block can be utilized for two different arrow velocities by, for example, placing the sight pins in openings 30' through 36' for a bow shooting 280 feet per second or openings 32' through 38' for a bow shooting 260 feet per second. Thus, the extra hardware needed for individual pin elevation adjustments are eliminated making the sight more compact. If the archer wishes to fine tune the distances between pins, the pins can be rotated or bent to bring them into the desired positions for the particular set up.

For securing pin block 24, within opening 14 a raised ridge 29 on both sides of frame 26 of bow speed specific sight pin block 24 is adapted to sit within recess 22 of opening 14. It is again emphasized that pin block 24 may be mounted to the bow by various mounting means and need not be mounted within a recess in the riser. In the illustrated embodiment, Allen screws 37 and 40 extend into the side of fame 26 and are screwable into contact with wedges 42 and 44, also located in frame 26 for moving wedges 42 and 44 into locking engagement with one of the sidewalls 15 of opening 14.

When the sight pins have been aligned to indicate their corresponding arrow flight ranges, to secure pin block 24 within opening 14, pin block 24 is perpendicularly inserted, in opening 14 of hand grip portion 4 as shown in FIG. 2. In this position, raised rib 29 on frame 26 is seated within recess 22 of opening 14. To insert pin block 24 in opening 14 it is necessary that wedge 42 and wedge 44 be in its retracted position within frame 26. Any extension of wedge 42 or wedge 44 outside of frame 25 would prevent the close fit of pin block 24 in opening 14. For illustration purposes, in FIGS. 5, 6, 7 and 7B, lower wedge 44 is shown as being in its retracted position within frame 26 while in FIGS. 5, 6, 7 and 7A upper wedge 42 is shown in its extended position outside of frame 26. In order for pin block 24 to be inserted in opening 14, it is necessary that both wedges 42 and 44 be in the retracted position of wedge 44, i.e., within frame 26. When wedges 42 and 44 are in their retracted position within frame 26, allen screws 37 and 40 are in the position of allen screw 40 shown in FIGS. 5, 6, 7 and 7B.

Figure 8:
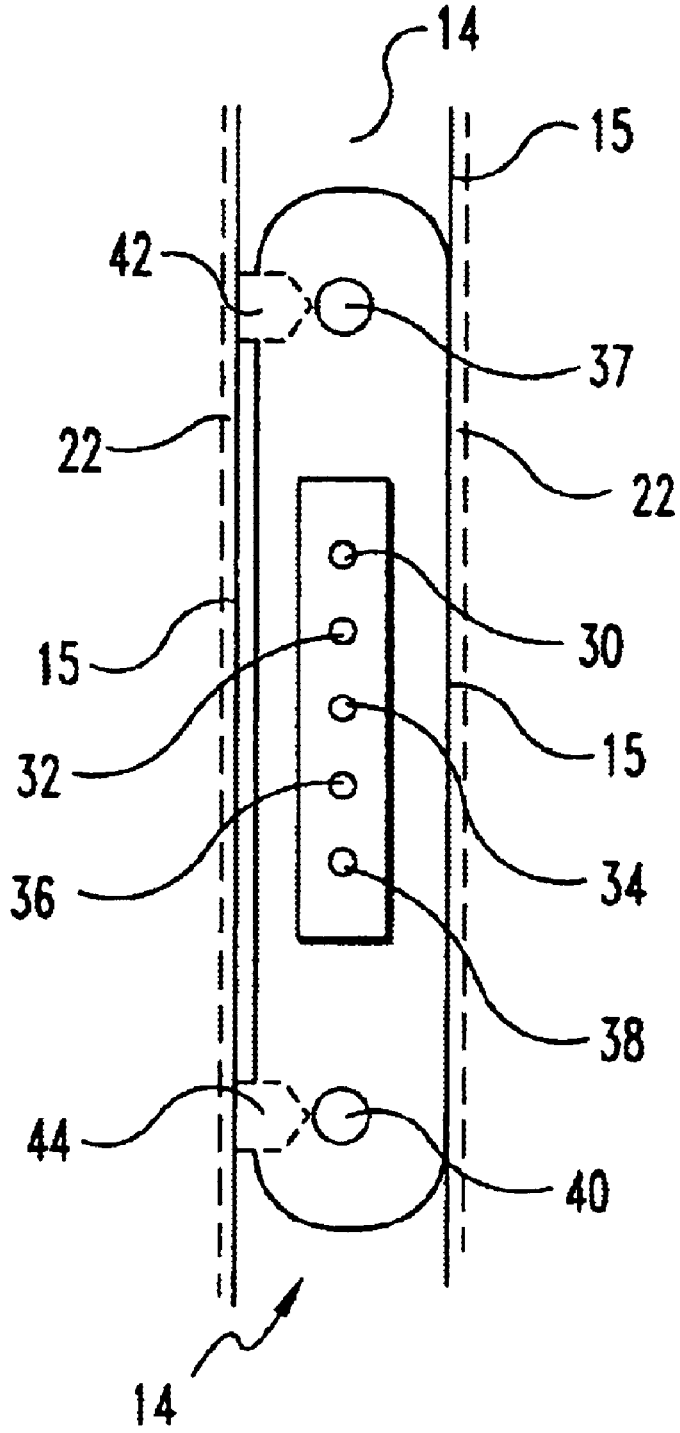
FIG. 8 is a side elevation similar to FIG. 7 and wherein both the upper and lower wedges are in engagement with a sidewall of the riser opening.

After pin block 24 is inserted in its desired height within opening 14, it is locked therein. To do so, allen screws 37 and 40 are screwed into contact with the taper portion of wedges 42 and 44 and move wedges 42 and 44 into the position shown by wedges 42 and 44 in FIG. 8. In this position wedges 42 and 44 press against a sidewall 15 of opening 14 to lock the pin block 24 in opening 14.

It will thus be appreciated that there is disclosed herein a modular self contained bow speed specific sight pin block, which in the illustrated embodiment requires no external bracketing, and wherein the sight pins are readily positioned to indicate their corresponding arrow flight range and wherein the sight pin block may be conveniently packaged, identified and stored for use or sale according to bow speed.

While particular embodiments of the invention have been described, it is not intended that the invention be limited thereto, as it is intended that the invention be as broad in scope as the art will allow and that the specification be read likewise.

I claim:

1. A method for producing a bow speed specific sight pin block for use in an archery bow comprising the steps of:

a. determining the bow speed;

b. firing the bow a first predetermined distance and determining a first location on the pin block for a first opening in which a first sight pin will be located to indicate the first predetermined distance;

c. providing a first opening in the first location of said pin block;

d. firing the bow at least a second predetermined distance and determining at least a second location in the pin block for at least a second opening in which a second sight pin will be located to indicate the at least second predetermined distance; and e. providing at least a second opening in the at least second location of said pin block.

2. A method for producing a bow speed specific sight pin block as recited in claim 1 and further including the step of transferring the sight pin block to a bow of the same known bow speed and whereby when placed in the bow of the same known bow speed only a single sight pin will have to be manually positioned to indicate its specific arrow flight range without any of the other sight pins having to be manually positioned to indicate their respective arrow flight range.

3. A method for producing a bow speed specific sight pin block as recited in claim 2, wherein said transferring includes placement of the bow speed specific sight pin block in an opening in the bow riser.

4. A method for producing a bow speed specific sight pin block as recited in claim 3, wherein the bow speed specific sight pin block includes a wedge which engages a wall in the opening in the bow riser.

5. A method for producing a bow speed specific sight pin block as recited in claim 1, further comprising the step of locating the first sight pin in the first opening in the pin block.

6. A method for producing a bow speed specific sight pin block as recited in claim 5, further comprising the step of locating the second sight pin in the second opening in the pin block.

7. A method for producing a bow speed specific sight pin block as recited in claim 1, further comprising the steps of:

a. firing the bow a third predetermined distance and determining a third location on the pin block for a third opening in which a third sight pin will be located to indicate the third predetermined distance;

b. providing a third opening in the third location of said pin block.

8. A method for producing a bow speed specific sight pin block as recited in claim 7, further comprising the step of locating the third sight pin in the third opening in the pin block.

9. A method for producing a bow speed specific sight pin block as recited in claim 1, further comprising the steps of:

a. firing the bow a plurality of predetermined distances and determining a plurality of locations on the pin block for a plurality of openings in which a plurality of sight pins will be located to indicate the plurality of predetermined distances; and, b. providing a plurality of openings in the plurality of locations of said pin block.

10. A method for producing a bow speed specific sight pin block as recited in claim 9, further comprising the step of locating a plurality of sight pins in the plurality of openings in the pin block.

* * * * *